US012584652B1

(12) United States Patent
Fairley

(10) Patent No.: US 12,584,652 B1
(45) Date of Patent: Mar. 24, 2026

(54) AIR CONDITIONER WATER TREATMENT AND OVERFLOW PREVENTION SYSTEM

(71) Applicant: Chandler Fairley, Purvis, MS (US)

(72) Inventor: Chandler Fairley, Purvis, MS (US)

( * ) Notice: Subject to any disclaimer, the term of this patent is extended or adjusted under 35 U.S.C. 154(b) by 224 days.

(21) Appl. No.: 18/436,771

(22) Filed: Feb. 8, 2024

(51) Int. Cl.
*F24F 11/42* (2018.01)
*F24F 13/22* (2006.01)

(52) U.S. Cl.
CPC ..... *F24F 13/222* (2013.01); *F24F 11/42* (2018.01)

(58) Field of Classification Search
CPC ..... F24F 13/222; F24F 11/42
See application file for complete search history.

(56) References Cited

U.S. PATENT DOCUMENTS

| | | | |
|---|---|---|---|
| 4,962,778 | A | 10/1990 | Driskell |
| 5,004,025 | A | 4/1991 | Robbins |
| 5,273,687 | A | 12/1993 | Osborne |
| 5,286,377 | A | 2/1994 | Galvan |
| 5,402,813 | A | 4/1995 | Keen |
| 5,461,879 | A | 10/1995 | Bolton et al. |
| 5,514,344 | A | 5/1996 | D'Agaro |
| 5,694,786 | A | 12/1997 | Huang |
| 5,722,458 | A | 3/1998 | Potter |
| 5,885,446 | A | 3/1999 | McGrew, Jr. |
| 5,911,742 | A | 6/1999 | Akazawa |
| 5,921,094 | A | 7/1999 | Bang |
| 5,964,238 | A | 10/1999 | Junkin |
| 5,975,113 | A | 11/1999 | Haining et al. |
| 5,976,364 | A | 11/1999 | Williams |
| 6,041,611 | A | 3/2000 | Palmer |
| 6,065,299 | A | 5/2000 | Chen |
| 6,068,023 | A | 5/2000 | Potter |
| 6,182,677 | B1 | 2/2001 | Pignataro |
| 6,303,039 | B1 | 10/2001 | Back et al. |
| 6,333,004 | B1 | 12/2001 | Sheldon |
| 6,427,458 | B1 | 8/2002 | Fowler |
| 6,487,867 | B1 | 12/2002 | Herren |
| 6,550,264 | B1 | 4/2003 | Cantolino |
| 6,584,995 | B2 | 7/2003 | Kimbrough et al. |
| 6,651,690 | B1 | 11/2003 | Coogle |
| 6,676,842 | B2 | 1/2004 | Scuilla et al. |
| 6,701,740 | B1 | 3/2004 | Hernandez-Zelaya |
| 6,877,333 | B1 | 4/2005 | Cantolino |
| 6,892,907 | B2 | 5/2005 | Varney |
| 6,895,770 | B1 | 5/2005 | Kaminski |

(Continued)

FOREIGN PATENT DOCUMENTS

| | | | |
|---|---|---|---|
| EP | 2085711 A2 | 5/2009 | |
| EP | 3945212 B1 * | 4/2024 | ..... F04D 13/16 |

*Primary Examiner* — Marina A Tietjen
(74) *Attorney, Agent, or Firm* — AdamsIP, LLC; Stephen Thompson; J. Hunter Adams

(57) ABSTRACT

A self-contained apparatus designed to treat condensate produced by an air conditioner and to prevent overflow of condensate from an air conditioner condensate drain pan is provided. The apparatus has an enclosure that includes a plumbing trap, a compartment that holds a chemical that treats condensate from the drain pan, and a reservoir that holds treated condensate. A pump transfers treated condensate from the reservoir back to the drain pan to prevent the growth of microorganisms in the drain pan and associated piping. Condensate may gravity flow from the apparatus to a drain line or may be pumped to the drain line.

20 Claims, 5 Drawing Sheets

(56) References Cited

U.S. PATENT DOCUMENTS

| | | | |
|---|---|---|---|
| 6,895,771 | B1 | 5/2005 | Cantolino |
| 6,915,814 | B2 | 7/2005 | Cheng |
| 6,976,367 | B2 | 12/2005 | Spanger |
| 6,992,928 | B2 | 1/2006 | Inoue |
| 7,067,056 | B2 | 6/2006 | Collins |
| 7,191,606 | B1 | 3/2007 | Dwyer |
| 7,392,658 | B1 | 7/2008 | Hardy, III |
| 7,392,821 | B2 | 7/2008 | Nakata et al. |
| 7,578,932 | B2 | 8/2009 | Cantolino |
| 7,686,034 | B1 | 3/2010 | Coogle |
| 7,740,025 | B2 | 6/2010 | Scaringe |
| 7,740,027 | B1 | 6/2010 | Coogle |
| 7,814,582 | B2 | 10/2010 | Reddy et al. |
| 7,857,004 | B2 | 12/2010 | Pearson |
| 7,930,898 | B2 | 4/2011 | Laufenberg et al. |
| 8,075,769 | B1 | 12/2011 | Gleason et al. |
| 8,104,502 | B2 | 1/2012 | Nakata et al. |
| 8,156,956 | B1 | 4/2012 | Coogle |
| 8,475,603 | B2 | 7/2013 | Kaiser |
| 8,479,760 | B2 | 7/2013 | Eads |
| 8,646,474 | B2 | 2/2014 | Pearson |
| 8,651,824 | B2 | 2/2014 | Ward |
| 8,961,708 | B2 | 2/2015 | Kaiser et al. |
| 8,967,183 | B2 | 3/2015 | Oakner et al. |
| 8,978,690 | B2 | 3/2015 | Hubbard, Sr. et al. |
| 9,182,181 | B2 | 11/2015 | Adams et al. |
| 9,212,475 | B2 | 12/2015 | Chabala |
| 9,217,577 | B2 | 12/2015 | Oakner et al. |
| 9,249,981 | B2 | 2/2016 | Sada et al. |
| 9,289,525 | B1 | 3/2016 | Mansor et al. |
| 9,352,986 | B2 | 5/2016 | Reinolds |
| 9,359,750 | B1 | 6/2016 | Perez |
| 9,551,504 | B2 | 1/2017 | Arensmeier et al. |
| 9,776,890 | B1 | 10/2017 | Patterson et al. |
| 9,943,778 | B1 | 4/2018 | Gutierrez et al. |
| 9,975,152 | B1 | 5/2018 | McClarren |
| 10,246,358 | B1 | 4/2019 | Lohse |
| 10,274,945 | B2 | 4/2019 | Arensmeier et al. |
| 10,370,181 | B1 | 8/2019 | Plummer |
| 10,514,182 | B1 | 12/2019 | Oviedo |
| 10,610,907 | B1 | 4/2020 | Scaringe et al. |
| 10,682,676 | B2 | 6/2020 | Raynes, II |
| 10,799,921 | B2 | 10/2020 | Rechlin |
| 10,822,257 | B2 | 11/2020 | Italia et al. |
| 10,830,489 | B2 | 11/2020 | Kilgo et al. |
| 10,895,422 | B1 | 1/2021 | Desilets |
| 10,933,452 | B1 | 3/2021 | Scaringe et al. |
| 11,022,124 | B2 | 6/2021 | Ward et al. |
| 11,029,076 | B1 | 6/2021 | Diaz-Yabor |
| 11,175,068 | B1 | 11/2021 | Desilets |
| 11,187,223 | B2 | 11/2021 | Ward et al. |
| 11,285,520 | B2 | 3/2022 | McDonald et al. |
| 11,320,172 | B1 | 5/2022 | Walker, Jr. |
| 11,333,394 | B2 | 5/2022 | Bush |
| 11,365,929 | B1 | 6/2022 | Marinelli |
| 11,517,946 | B1 | 12/2022 | Bullard |
| 11,585,566 | B2 | 2/2023 | Conley |
| 11,696,965 | B1 | 7/2023 | Musco |
| 11,719,464 | B1 | 8/2023 | McDonnell |
| 2002/0000093 | A1 | 1/2002 | Lea |
| 2006/0096307 | A1 | 5/2006 | Coogle |
| 2006/0191833 | A1 | 8/2006 | Greene, III et al. |
| 2009/0071182 | A1 | 3/2009 | Lin |
| 2011/0017678 | A1 | 1/2011 | Anderson |
| 2011/0114572 | A1 | 5/2011 | Stoltz |
| 2011/0308618 | A1 | 12/2011 | Lorenz |
| 2011/0308636 | A1 | 12/2011 | Kaiser |
| 2013/0264294 | A1 | 10/2013 | McDermott |
| 2014/0130888 | A1 | 5/2014 | Kaiser et al. |
| 2014/0216093 | A1 | 8/2014 | Kaiser et al. |
| 2016/0320088 | A1 | 11/2016 | Lau |
| 2017/0036515 | A1 | 2/2017 | Ko |
| 2017/0045282 | A1 | 2/2017 | Thornberry, Jr. |
| 2017/0112889 | A1 | 4/2017 | Spencer et al. |
| 2019/0170392 | A1* | 6/2019 | Powell ..... C01F 1/00 |
| 2019/0186781 | A1 | 6/2019 | Vanderhaar |
| 2020/0049372 | A1 | 2/2020 | Thompson |
| 2020/0070217 | A1 | 3/2020 | Rose |
| 2021/0041137 | A1 | 2/2021 | Collins |
| 2021/0172622 | A1 | 6/2021 | Flaxer |
| 2022/0073385 | A1 | 3/2022 | Herbkersman |
| 2022/0186485 | A1 | 6/2022 | Grumbach et al. |

* cited by examiner

AIR CONDITIONER WATER TREATMENT AND OVERFLOW PREVENTION SYSTEM

FIELD OF THE INVENTION

The present invention relates generally to a system designed to treat condensate produced by an air conditioner and to prevent overflow of condensate from an air conditioner condensate collection pan.

BACKGROUND

Air conditioner units produce condensate that drips from evaporator coils and falls downward to be collected in a container, which is commonly referred to as a drain pan, drip pan, collection pan, or condensate pan, that is located below the evaporator coil. The drain pan typically has a port on a bottom of the pan that allows the collected condensate to drain to a drain line that conveys the condensate to a location external to the building in which the unit is installed. In residential applications, the condensate is typically allowed to flow to the drain line by gravity, or it can be pumped when gravity flow is not practical. The condensate flows through a P-trap downstream of the drain pan before flowing to the drain line to prevent any potential backflow of gases from the drain line to the air conditioning unit.

Whenever the air conditioning unit of an HVAC system is running, condensate is continuously produced due to the chilled coil condensing humidity from air passing over the coil. During this time, the presence of condensate often leads to the growth of microorganisms, such as algae or mold, in the drain pan and/or condensate drain lines. Excessive growth of such microorganisms may lead to blockage of drain lines, which may cause condensate to accumulate in the drain pan and eventually overflow, which may cause significant damage to surrounding structures of the building. Drain pans typically have a float switch or other type of overflow prevention device that shuts down the air conditioning unit to stop condensate formation and accumulation and thus prevent the overflow of condensate from the drain pan.

To prevent the formation of blockages due to microorganism growth, chemicals are frequently added to the system to treat the condensate. For instance, bleach may be poured into the drain pan or drain line at scheduled time intervals, such as once per month. Systems have also been developed to automatically treat the condensate, such as systems using chlorine tablets, algaecide tablets, or other solid treatment chemicals over which the condensate flows or systems that automatically inject treatment chemicals into the condensate collection and drainage system. Such condensate treatment systems can be effective but are generally not required by commonly used HVAC-related codes and standards. Thus, many installed air conditioning units do not have these systems and instead rely primarily on float switches to prevent condensate overflow or manual addition of treatment chemicals, which is often unreliable due to inattention by users or owners.

SUMMARY

In one aspect, an apparatus designed to treat condensate produced by an air conditioner and to prevent overflow of condensate from an air conditioner condensate drain pan is provided. The apparatus includes a plumbing trap, such as a P-trap, to prevent backflow of gases and can be installed as a single, self-contained unit on a condensate outlet line that drains condensate from a drain pan. The apparatus includes an enclosure, which preferably has a wet side and a dry side within the same structural enclosure. The wet side has a water inlet and a water outlet. The water inlet supplies condensate water from the drain pan to the wet side of the enclosure, and the water outlet coneys water from the enclosure to a drain line external to the enclosure, which is typically a common drain line used for the discharge of water throughout the building. When condensate enters the enclosure, it flows through the P-trap and then to a compartment holding a solid treatment chemical. The compartment has a perforated bottom to allow the condensate to flow by gravity from the compartment to a reservoir disposed in a position directly below the compartment. The water dissolves the solid chemical over a period of time to produce treated condensate, which accumulates within the reservoir. A pump, which is preferably disposed within the dry side of the enclosure, is configured to pump the treated condensate from the reservoir back to the drain pan, thereby also treating the drain pan to prevent the growth of microorganisms in the drain pan before the treated condensate is recirculated back to the enclosure through the water inlet.

In one embodiment, the reservoir is partially defined by an overflow wall, and the water outlet is disposed at a lower end of the wet side of the enclosure on an opposite side of the overflow wall from the reservoir. The apparatus preferably also comprises a water level sensor configured to detect a water level within the reservoir and a controller configured to control operation of the pump based at least in part on input from the water level sensor. The pump may be activated intermittently to pump treated condensate back to the drain pan to recirculate the treated condensate and thus treat all parts of the system in which condensate may be present and potentially cause microorganism growth. When a sufficient amount of treated condensate accumulates within the reservoir, the condensate can flow over the overflow wall and into the water outlet, which then conveys the water to the drain line. In some embodiments, the apparatus may include a second pump configured to pump treated condensate from the reservoir to the drain line or to a secondary air conditioning unit. The apparatus preferably includes a high-level sensor disposed at an upstream end of the P-trap. The high-level sensor is configured to shut down the air conditioning unit if the sensor detects a high water level at the upstream end of the trap. This is designed to prevent backflow of condensate from the apparatus back to the drain pan in the event of a system failure, which may then cause condensate overflow from the drain pan.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
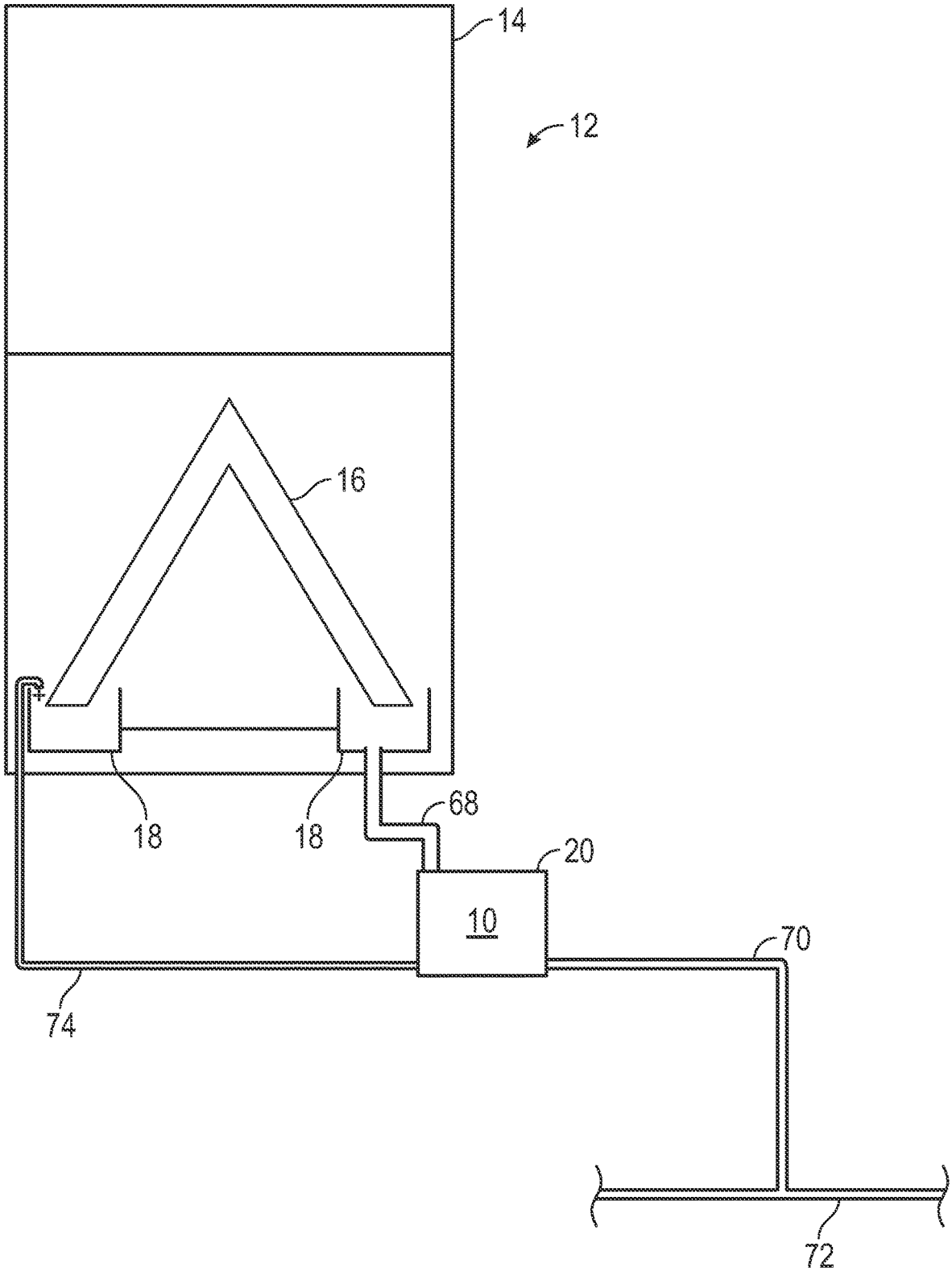
FIG. 1 shows a schematic view of an air conditioner unit in accordance with the present disclosure.

In one aspect, an apparatus 10 designed to treat condensate produced by an air conditioner 12 and to prevent overflow of condensate from an air conditioner condensate drain pan 18 is provided. FIGS. 2-6 illustrate preferred embodiments of the apparatus 10. The apparatus 10 can be installed as a single, self-contained unit onto a condensate outlet line 68 between the drain pan 18 and a main drain line 72 that conveys water from the building in which the air conditioner unit 12 is installed so that all condensate produced by the unit 12 passes through the apparatus 10. The apparatus 10 may provide a water treatment system, a trap, and an overflow prevention system in a single device so that these components or systems can be installed as a single unit and do not need to be separately installed on any air conditioner (AC) unit or heating, ventilation, and air conditioning (HVAC) unit. FIG. 1 shows components of an example AC unit 12 onto which the apparatus 10 can be installed. The AC unit 12 may comprise an air handling unit 14 having a blower for moving air, an evaporator having an evaporator coil 16, and a condenser 15. The drain pan 18 is positioned directly below the evaporator coil 16 so that condensate that forms on the coil 16 during normal operation of the AC unit 12 falls downward and is collected in the drain pan 18. As water accumulates in the drain pan 18, the water may gravity flow from the drain pan 18 into the condensate outlet line 68, which functions as a water inlet line 68 to the apparatus 10. Once the condensate is treated within the apparatus 10, a portion of the treated condensate can be pumped back to the drain pan 18 through a recirculation line 74, and the remaining treated condensate can be allowed to gravity flow to the main drain line 72 through a water outlet line 70, or, optionally, the condensate may be pumped to the drain line 72.

Figure 2:
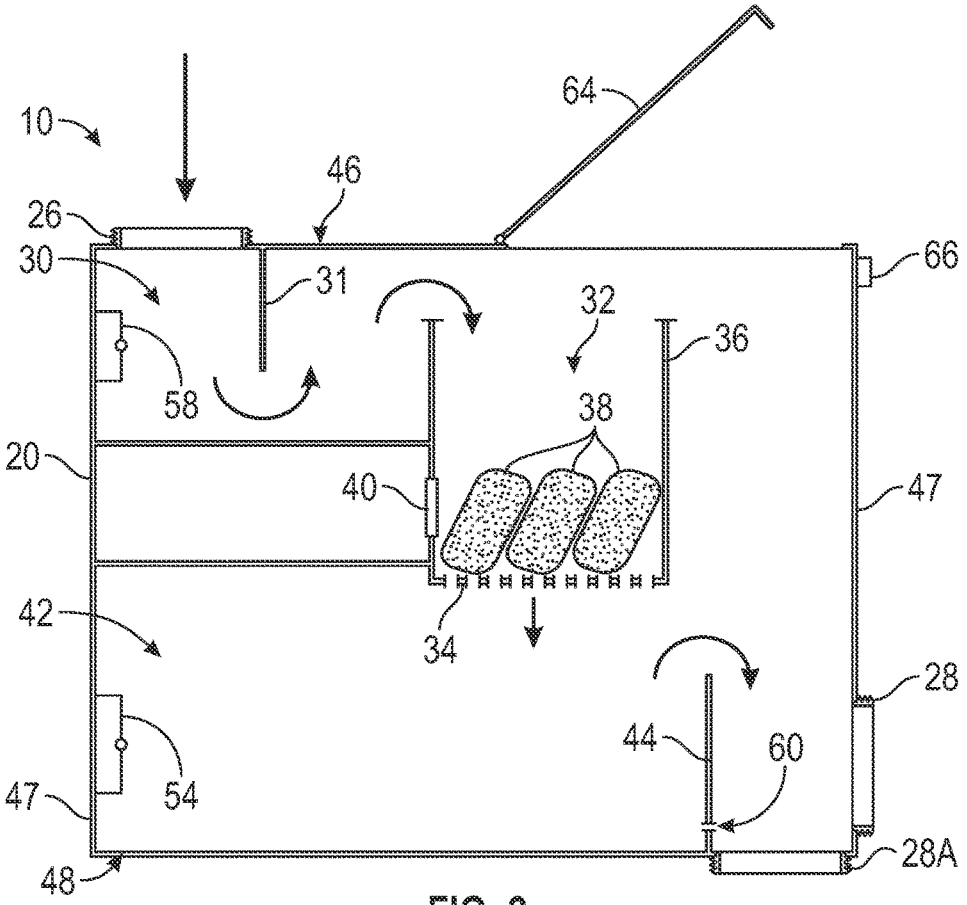
FIG. 2 shows a cross-sectional view of an apparatus for treating air conditioner condensate in accordance with the present disclosure.
Figure 3:
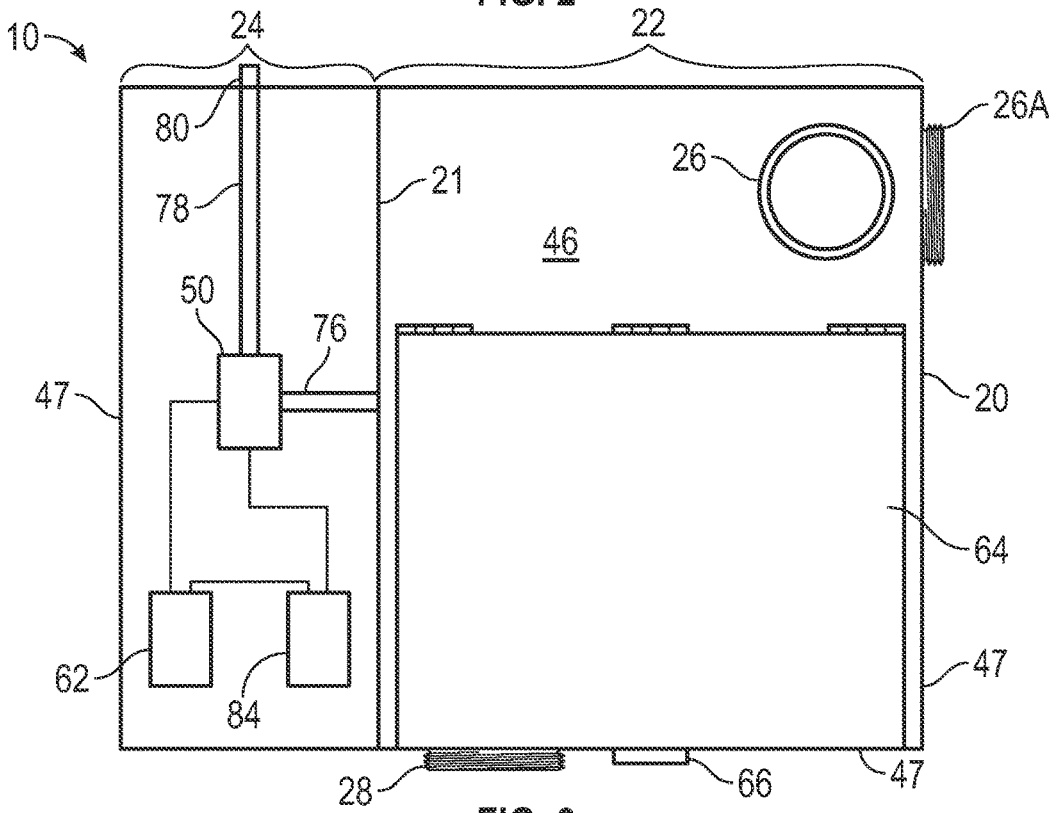
FIG. 3 shows a top view of an apparatus for treating air conditioner condensate in accordance with the present disclosure.
Figure 4:
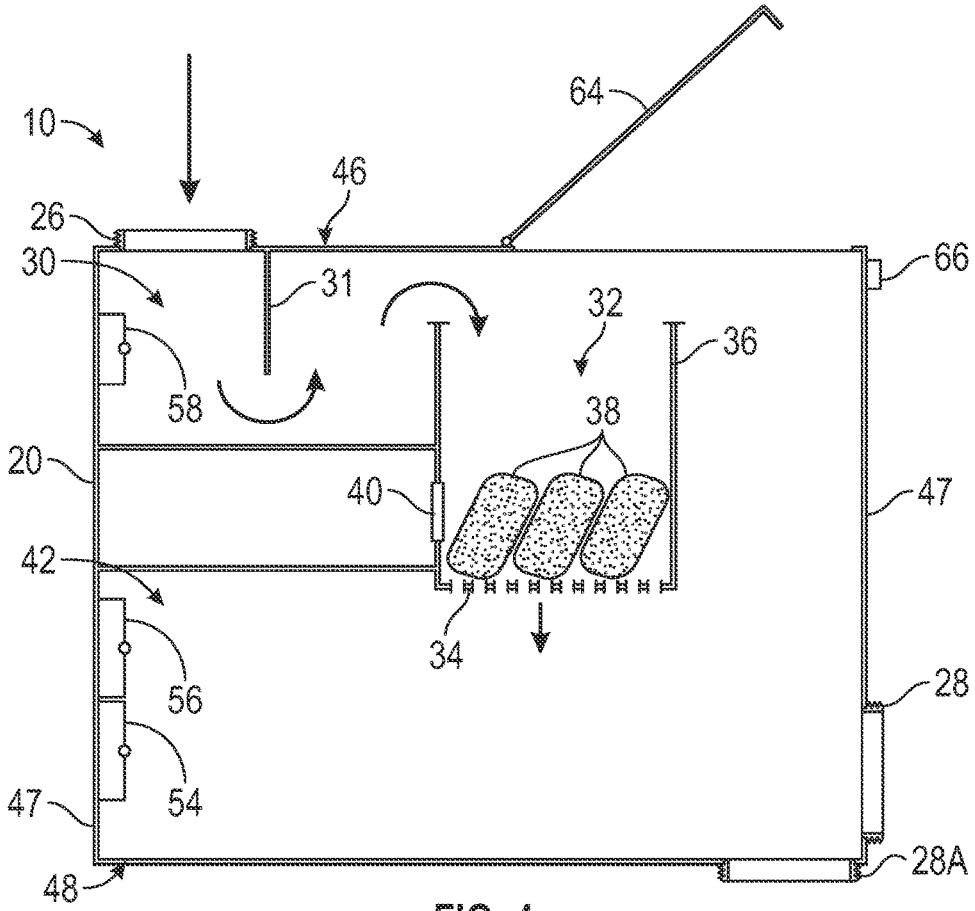
FIG. 4 shows a cross-sectional view of an apparatus for treating air conditioner condensate in accordance with the present disclosure.
Figure 5:
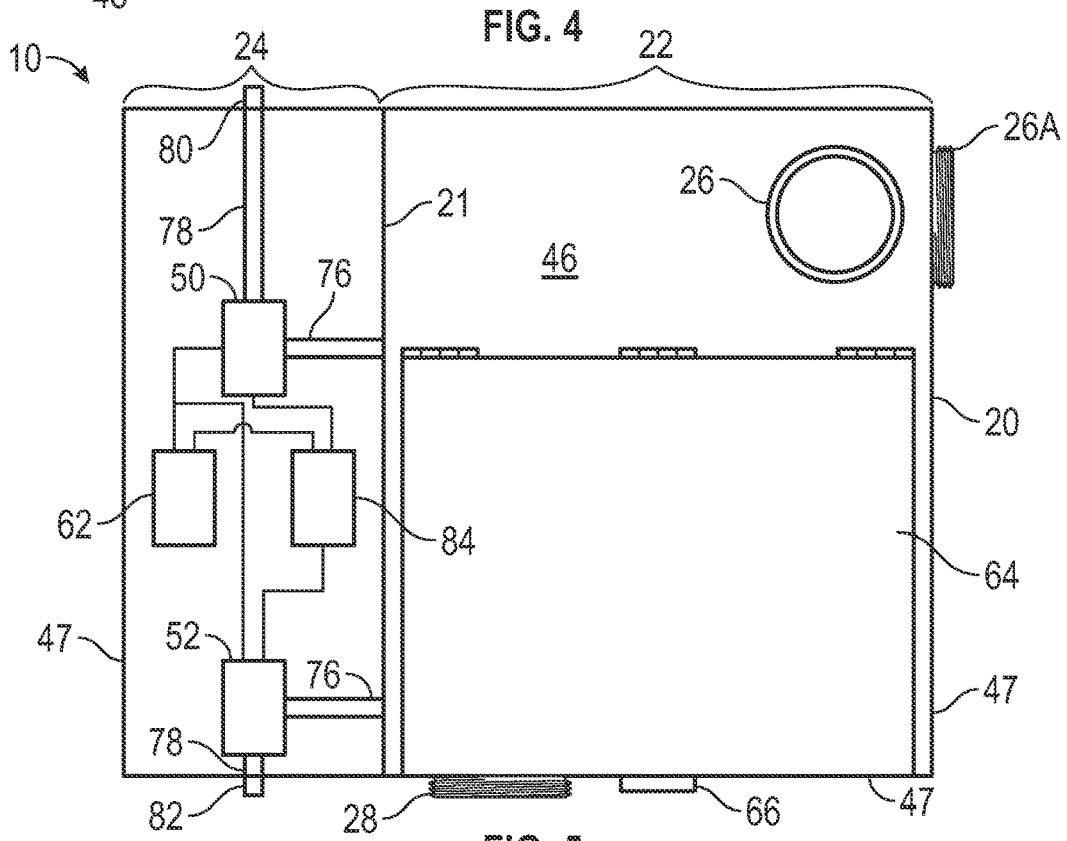
FIG. 5 shows a top view of an apparatus for treating air conditioner condensate in accordance with the present disclosure.

The apparatus 10 includes an enclosure 20, which preferably includes a wet side 22 and a dry side 24, as best seen in FIGS. 3 and 5, each of which illustrates a top view of embodiments of the apparatus 10 showing internal components housed within the dry side 24 of the enclosure 20. The wet side 22 and the dry side 24 may be separated by a divider wall 21. FIGS. 2 and 4 show a cross-sectional view of the wet side 22 of the enclosure 20 of the embodiments shown in FIGS. 3 and 5, respectively. The wet side 22 has a water inlet 26 and a water outlet 28. The water inlet 26 comprises a connection fitting configured to connect the apparatus 10 to the water inlet line 68, which conveys condensate from the drain pan 18 to the wet side 22 of the enclosure 20. The water outlet 28 comprises a connection fitting configured to connect the apparatus 10 to the water outlet line 70, which conveys condensate from the wet side 22 of the enclosure 20 to the drain line 72, which is typically a common drain line used for the discharge of water from various sources throughout the building in which the AC unit 12 is installed. In a preferred embodiment, each of the water inlet 26 and water outlet 28 comprises a threaded connection, preferably having male threads, attached to an exterior of the enclosure 20. In one embodiment, the water inlet 26 and water outlet 28 may each be sized to connect ¾ inch pipe to the connection fittings.

The enclosure 20 preferably has the shape of a cuboid having six sides, including a top side 46 disposed at an upper end of the enclosure 20, a bottom side 48 disposed at a lower end of the enclosure 20, and four vertical sidewalls 47 connecting the top 46 and bottom 48 when the apparatus 10 is installed in an upright position, as shown in FIG. 2. In one embodiment, each of the six sides may have dimensions of approximately six inches by six inches. Alternatively, the enclosure 20 may have the shape of a rectangular cuboid or other suitable shape. The wet side 22 may thus be defined by a portion of the top side 46, a portion of the bottom side 48, the divider wall 21, and all or portions of three of the vertical sidewalls 47. The water inlet 26 is disposed at the upper end of the wet side 22 of the enclosure 20 and is preferably positioned on the top side 46 of the enclosure 20, as shown in FIGS. 2 and 3. The enclosure 20 may optionally include a second water inlet 26A disposed at the upper end of the wet side 22 of the enclosure 20 but on a vertical side 47 of the enclosure 20 rather than on the top side 46, as shown in FIG. 3. Depending on the specific physical configuration of the AC unit 12 and other structures at the building location where the apparatus 10 is installed, either inlet 26 or 26A may be used to connect water inlet line 68 to the wet side 22 of the enclosure 20. Whichever of inlets 26 and 26A that is not used can be plugged or capped to seal the wet side 22 of the enclosure 20. The water outlet 28 is disposed at the lower end of the wet side 22 of the enclosure 20 and is preferably positioned on a vertical side 47 of the enclosure near the bottom side 48 of the enclosure 20, as shown in FIGS. 2 and 3. The enclosure 20 may optionally include a second water outlet 28A disposed at the lower end of the wet side 22 of the enclosure 20 and positioned on the bottom side 48 of the enclosure 20, as shown in FIG. 2. Either outlet 28 or 28A may be used to connect to water outlet line 70 and the other can be capped or plugged to seal the wet side 22 of the enclosure 20. The wet side 22 of the enclosure 20 forms a watertight enclosure that does not allow water to escape the enclosure 20 when the enclosure 20 is in an upright position except when the water drains through outlet 28 or 28A or is pumped out of the enclosure 20. The top side 46 of the enclosure 20 preferably has a lid 64 that allows access into the wet side 22 of the enclosure 20. The lid 64 is preferably attached to the enclosure 20 by hinges and may have a release button 66 configured to secure the lid 64 in a closed position, as shown in FIG. 3, and to release the lid 64 to allow the lid 64 to be moved to an open position, as shown in FIG. 2.

The apparatus 10 includes a plumbing trap 30 disposed within the wet side 22 of the enclosure 20 to prevent backflow of gases. The trap 30 has a U-shaped portion of pipe or similar conduit configured to trap liquid condensate in a low point within the trap 30 to create an air seal and thus prevent any potential backflow of gases from the drain line 72 back through the enclosure 20 and back to the drain pan 18. In a preferred embodiment, as best seen in FIG. 2, the plumbing trap is a P-trap 30. In alternative embodiments, the trap may have an S-shape or any other similar shape that is suitable for use as a trap to prevent backflow of gases. In a preferred embodiment, the P-trap 30 is disposed directly adjacent to the water inlet 26 to that condensate from the drain pan 18 flows immediately into the trap 30 when the condensate enters the wet side 22 of the enclosure 20. The condensate then flows through the trap 30 and then to a compartment 32 holding a solid treatment chemical 38, as indicated by the direction arrows shown in FIGS. 2 and 4. The compartment 32 is also disposed within the wet side 22 of the enclosure 20 and preferably in a position downstream of the trap 30. The compartment 32 has a perforated bottom 34 having a plurality of perforations or openings that allow the condensate to flow by gravity from the compartment 32 downward into a reservoir 42 designed to hold a volume of treated condensate. The reservoir 42 is also disposed within the wet side 22 of the enclosure 20 and in a position directly below the compartment 32 to allow gravity flow of condensate downward from the compartment 32 directly into the reservoir 42.

In a preferred embodiment, the solid treatment chemical 38 comprises algaecide tablets. In other embodiments, the solid treatment chemical 38 may comprise chlorine tablets or other solid chemicals suitable for treating condensate, which may be in the form of pellets, granules, or another suitable solid form over which the condensate can flow and then flow downward into the reservoir 42. As the condensate flows over the treatment chemical 38, the condensate slowly dissolves the solid chemical 38 over a period of time to produce treated condensate, which then accumulates within the reservoir 42. The compartment 32 may be defined by the perforated bottom 34 and one or more sidewalls, which may include an overflow wall 36 configured to allow condensate to flow over the wall 36 and downward into the reservoir 42 and/or to the water outlet 28 in case the perforated bottom 34 of the compartment 32 becomes blocked and the condensate cannot flow directly through the bottom 34 into the reservoir 42. Overflow wall 36 is preferably disposed on an opposite side of the compartment 32 from the trap 30, as shown in FIG. 2.

The solid treatment chemical 38 can be manually placed within an interior of the compartment 32 by opening the lid 64 of the enclosure 20 to access the compartment 32. The solid treatment chemical 38 must be replaced periodically once the solid chemical 38 has dissolved fully or to a threshold amount due to condensate flowing over, through, and/or around the chemical 38. In a preferred embodiment, as shown in FIG. 2, the apparatus 10 may comprise a treatment chemical sensor 40 configured to detect the presence of solid treatment chemical 38. In a preferred embodiment, the treatment chemical sensor 40 comprises an optical proximity sensor designed to detect a defined physical level of the chemical 38 within the compartment 32, which may be defined by the vertically highest physical height of chemical 38 above the bottom 34 of the compartment 32. When the physical level of the chemical 38 within the compartment 32 drops below the defined threshold level, the sensor 40 may be configured to provide an alert to notify a user that the chemical 38 needs to be replenished. The alert may be in the form of a light on the exterior of the apparatus 10 or an audible alarm sound emitted from the apparatus 10. In other embodiments, the apparatus 10 may be configured to provide remote alerts by text message or email to a user's computing device. In other alternative embodiments, the sensor 40 may be another type of sensor suitable for detecting the presence or absence of a solid chemical 38, including any other suitable type of proximity sensor or other type of optical sensor.

In a preferred embodiment, as shown in FIG. 2, the reservoir 42 is at least partially defined by an overflow wall 44 that separates the reservoir 42 from the water outlet 28, which is disposed on an opposite side of the overflow wall 44 from the reservoir 42. The overflow wall 44 extends from one of the vertical sides 47 to the divider wall 21. The overflow wall 44 also extends upwardly from the bottom side 48 and is configured to contain condensate within the reservoir 42 up to an upper height of the wall 44. The reservoir 42 may also be defined by the bottom side 48 of the wet side 22 of the enclosure 20, a portion of the divider wall 21, and portions of one or more vertical sidewalls 47 of the wet side 22 of the enclosure 20. The overflow wall 44 is designed to allow condensate to flow over the wall 44 from the reservoir 42 to the water outlet 28 when the reservoir 42 fills with condensate to the top of the overflow wall 44. The overflow wall 44 preferably has a weep hole 60 extending through the wall 44 at a position near a lower end of the wall 44. If the AC unit 12 is shut off and is thus no longer producing condensate, the weep hole 60 may allow any accumulated condensate remaining in the reservoir 42 to slowly drain to the water outlet 28.

The apparatus 10 further comprises a pump 50 configured to pump condensate from the reservoir 42 to a discharge location that is external to the enclosure 20. In one embodiment, the apparatus 10 may comprise a first pump 50 and a second pump 52 configured to pump condensate from the reservoir 42 to different discharge locations that are external to the enclosure 20. FIG. 3 shows an embodiment having a single pump 50, and FIG. 5 shows an embodiment having both pumps 50 and 52. In both embodiments, the first pump 50 may be used to pump treated condensate from the reservoir 42 back to the drain pan 18 through recirculation line 74, as shown in FIG. 1. In some embodiments, as discussed below, the second pump 52 may be configured to pump condensate from the reservoir 42 to drain line 72 through water outlet line 70 when gravity flow of the condensate into water outlet 28 is not practical, such as is common in some commercial applications, or alternatively to a secondary AC unit drain pan.

Each of the pumps 50 and 52 are preferably disposed within the dry side 24 of the enclosure 20, which may be utilized to house components of the apparatus 10 that remain dry during operation of the apparatus 10. The dry side 24 is separate from the wet side 22 but is preferably formed by the same structural enclosure 20 such that both portions are defined by a single enclosed structure with a sealed water-tight dividing wall 21 separating the sides 22 and 24. The dry side 24 may thus be defined by a portion of the top side 46, a portion of the bottom side 48, the divider wall 21, and all or portions of three of the vertical sidewalls 47. The dry side 24 is preferably enclosed to provide protection to components housed therein from damage and generally from exposure. The dry side 24 may have an access door (not shown) for installing, removing, or accessing any of the components housed within the dry side 24 of the enclosure 20. Alternatively, the dry side 24 may not be enclosed but may include structural support components attached to an exterior of the wet side 22 of the enclosure 20 for mounting the pumps 50, 52 and other components so that these components are attached to the enclosure 20 to form a self-contained unit. In other alternative embodiments, pumps 50 and/or 52 may be housed within the reservoir 42. In a preferred embodiment, a battery 62 may also be housed within the dry side 24 of the enclosure 20 to provide electrical power to both pumps 50 and 52 as well as to other components of the apparatus 10.

A pump inlet line 76 may extend through divider wall 21 to fluidly connect the reservoir 42 to an inlet to pump 50. A separate pump inlet line 76 may extend through divider wall 21 to fluidly connect the reservoir 42 to an inlet to pump 52. A pump outlet line 78 may extend from a discharge outlet of pump 50 and through an opening in one of the sidewalls 47. Similarly, a separate pump outlet line 78 may extend from a discharge outlet of pump 52 and through an opening in one of the sidewalls 47. An outlet fitting 80 may be installed on the exterior of a sidewall 47 for connecting the recirculation line 74 to the fitting 80 so that the discharge outlet of pump 50 is fluidly connected to the recirculation line 74, thereby allowing pump 50 to be used to pump treated condensate back to the drain pan 18. An outlet fitting 82 may also be installed on the exterior of a sidewall 47 for connecting a water outlet line 70 or a separate condensate recirculation line to the fitting 82 so that the discharge outlet of pump 52 is fluidly connected to the water outlet line 70, thereby allowing pump 52 to be used to pump treated condensate to the main drain line 72 in embodiments in which it is not feasible or not desired to allow the condensate to gravity flow out of water outlet 28, or to the condensate recirculation line. Each of fittings 80 and 82 is preferably a barbed fitting for connecting a flexible rubber or plastic hose to the fitting when installing the apparatus 10.

In a preferred embodiment, the apparatus 10 further comprises a water level sensor 54 configured to detect a water level within the reservoir 42, as best seen in FIG. 2. In some embodiments, the apparatus 10 may include a second water level sensor 56 also configured to detect a water level within the reservoir 42, as best seen in FIG. 4. In this embodiment, water level sensor 54 may be associated with pump 50, and water level sensor 56 may be associated with pump 52. In embodiments utilizing two pumps, overflow wall 44 may not be required for the apparatus 10 to function, as discussed below. In a preferred embodiment, the apparatus 10 further comprises an emergency high-level sensor 58 and alarm. As best seen in FIGS. 2 and 4, the high-level sensor 58 is preferably disposed at an upstream end of the P-trap 30. The high-level sensor 58 is configured to shut down the air conditioning unit 12 by disconnecting power to the unit 12 if the sensor 58 detects a high water level at the upstream end of the trap 30. This is designed to prevent excessive accumulation of condensate from filling the wet side 22 of the enclosure 20 and then backflowing from the apparatus 10 back into the drain pan 18 in the event of a system failure such as a drain blockage or pump 50, 52 failure, which may cause the drain pan 18 to overflow and cause water damage to surrounding structures of the building in which the unit 12 is installed. High-level sensor 58 may include a float switch that automatically disconnects power to the AC unit 12 if a water level at sensor 58 reaches an upper set point indicating backflow through the trap 30. The upper set point is vertically higher than a lower end of wall 31 that separates the inlet and outlet of the trap 30 to form a low point of the trap 30 so that normal water accumulation in the low point of the trap 30 does not cause the high-level sensor 58 to deactivate the AC unit 12.

Figure 6:
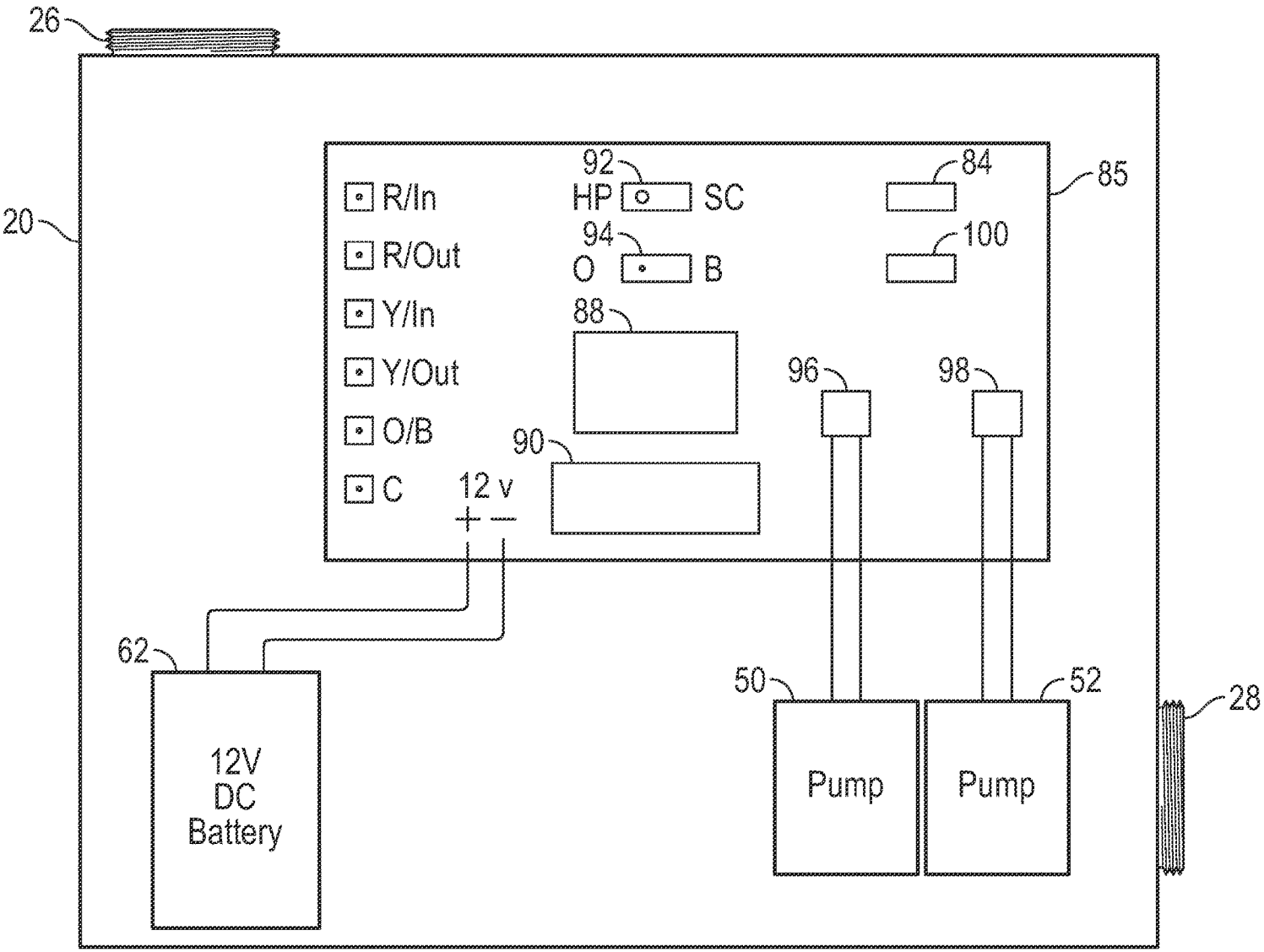
FIG. 6 shows a schematic view of an apparatus for treating air conditioner condensate in accordance with the present disclosure.
Figure 7:
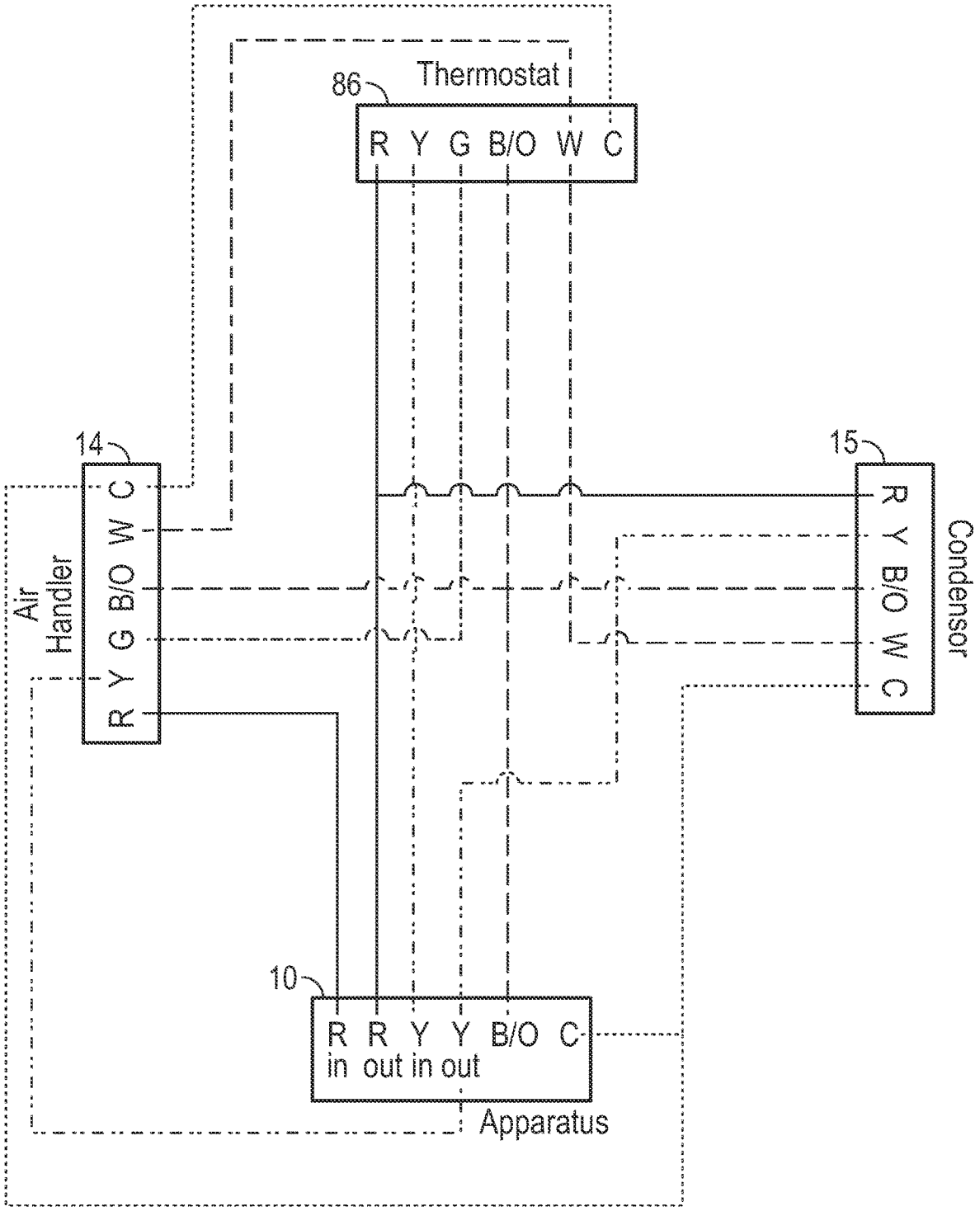
FIG. 7 shows a schematic view of an air conditioner system in accordance with the present disclosure.

In a preferred embodiment, the apparatus 10 further comprises a controller 84 configured to control operation of pump 50 and/or pump 52 based on input from water level sensor 54 and/or water level sensor 56, respectively, or other inputs. The controller 84 is preferably housed within the dry side 24 of the enclosure 20, as best seen in FIGS. 3 and 5. As shown in FIG. 6, the controller may comprise a microcontroller 84 containing at least one central processing unit (CPU) and a plurality of programmable inputs/outputs wired onto a printed circuit board (PCB) 85. The controller 84 can be programmed to control operation of the pumps 50 and/or 52 and to function as an emergency shut down system based on feedback from high-level sensor 58. FIG. 7 illustrates a schematic diagram of how the apparatus 10 may be wired to the air handling unit 14, the condenser 15, and a thermostat 86 configured to control a temperature setting for the AC unit 12. FIG. 6 shows an example PCB 85 having a controller 84 and a plurality of terminals for alternating current (AC) electrical power ("R" indicating a 24V positive connection and "C" indicating a 24V negative connection), air conditioner operation ("Y"), and optional heat pump operation ("O/B") for units that include a heat pump. The PCB 85 may be wired to existing low voltage wiring of the AC unit 12 to provide power to the apparatus 10 and to maintain a charge on the battery 62, which in turn provides electrical power to pumps 50 and/or 52. The PCB 85 preferably includes a 24V AC converter 88 that is configured to convert power to 12V DC (direct current) to charge the battery 62. The PCB 85 preferably also includes a set of connectors 90 for sensor wiring from sensor 54 and/or 56, sensor 58, and/or sensor 40. The PCB 85 may have one or more switches, which are preferably DIP (dual in-line package) switches, for selecting between different types of systems including switch 92 for switching between "HP" (heat pump) and "SC" (straight cool) for optional installation of the apparatus 10 on systems utilizing a heat pump and optional switch 94 for selecting between different types of heat pump systems depending on the failure mode of the particular heat pump system on which the apparatus 10 is installed. The PCB 85 may also include relay 96 for energizing pump 50 and relay 98 for energizing pump 52.

FIGS. 2 and 3 illustrate an embodiment with a single condensate pump 50. The pump 50 may be activated intermittently to pump treated condensate back to the drain pan 18 to recirculate the treated condensate and thus treat all parts of the system 12 and associated piping in which condensate may be present and potentially cause microorganism growth. As the AC unit 12 operates for cooling, condensate forms on the exterior of the chilled evaporator coil 16 and then falls down into the drain pan 18. The condensate then drains from the drain pan 18 through line 68 and into the wet side 22 of the enclosure 20 of the apparatus 10. After entering the enclosure 20, the condensate first passes through the trap 30, which retains an amount of water in a low point to create an air seal that ensure that gases do not backflow through the apparatus 10 back to the drain pan 18. The condensate then flows into compartment 32 to be treated by chemical 38. As the treatment chemical 38 dissolves into the condensate, the treated condensate then flows down through the bottom 34 of the compartment and falls into the reservoir 42 where the treated condensate is allowed to accumulate while the unit 12 is running.

When a sufficient amount of treated condensate accumulates within the reservoir 42, the condensate may be removed from the reservoir 42 in two ways. First, at least a portion of the treated condensate is pumped by pump 50 back to the drain pan 18. This allows treated condensate to contact surfaces within the interior of the drain pan 18 and within line 68 when the treated condensate is recycled back to the apparatus 10 from the drain pan 18, thereby treating these surfaces to prevent the growth of microorganisms in the drain pan 18, line 68, and in portions within the wet side 22 of the enclosure 20 that are upstream of compartment 32. Second, treated condensate also flows over the overflow wall 44 through the water outlet 28 and into condensate line 70, which then conveys the condensate to the main drain line 72. In this embodiment, the condensate flows by gravity to the drain line 72 and in the process also treats condensate line 70 and drain line 72 to prevent blockages in these lines due to microorganism growth.

In one embodiment, as treated condensate first begins to accumulate in the reservoir 42 after the AC unit 12 is activated, the pump 50 may be activated upon a water level reaching a set point determined by water level sensor 54. Water level sensor 54 may include a float switch that automatically activates the pump 50 upon the condensate level in the reservoir 42 reaching the set point. The condensate level in the reservoir 42 may initially fall after activation of the pump 50 causes some condensate to be recirculated back to the drain pan 18 but may then increase due to both new condensate formation from evaporator coil 16 and treated condensate recirculation both flowing simultaneously back to the apparatus 10. When this occurs, the level of condensate in the reservoir 42 may rise to the height of overflow wall 44, thereby resulting in treated condensate flowing over wall 44 and out of the enclosure 20 through the water outlet 28.

In one embodiment, the controller 84 may include a timer 100 configured to activate the pump 50 at set time intervals while the AC unit 12 is operating. For instance, the pump 50 may be activated to pump condensate at a set period of time after initiation of cooling by the AC unit 12. The controller 84 may be programmed to run the pump 50 for a set amount of time and then stop the pump 50. When the pump 50 is stopped, treated condensate may accumulate within the reservoir 42 to the height of the overflow wall 44 and flow through the water outlet 28. After a set period of time, the pump 50 may then be reactivated to recirculate treated condensate back to the drain pan 18. This process may be repeated as long as the cooling function of the AC unit 12 is operating. In one embodiment, the controller 84 may be programmed to control operation of the pump 50 based on inputs from both the water level sensor 54 and the timer 100. For instance, the pump 50 may be initially activated by the condensate level in the reservoir 42 reaching the set point of water level sensor 54. The pump 50 may then be set to run for a set period of time, which may be controlled by the timer 100. After the pump 50 is shut off, it may be reactivated at set time intervals as long as the AC unit 12 is operating in cooling mode and thus producing condensate. After the AC unit 12 shuts off, the controller 84 may be programmed to run the pump 50 at least until the condensate level drops below the set point of water level sensor 54.

In an alternative embodiment, as shown in FIGS. 4 and 5, the apparatus 10 may include a second pump 52 configured to pump treated condensate out of the reservoir 42. This embodiment may be advantageous in systems in which it is not feasible to allow condensate to flow by gravity to the main drain line 72 or in systems including multiple AC units 12. In this embodiment, overflow wall 44 may not be required for certain applications, as best seen in FIG. 4, in which case both water outlets 28 and 28A may be plugged to prevent the outflow of condensate through these outlets. In this case, the reservoir 42 may be partially defined by additional portions of the bottom 48 and sidewalls 47 of the enclosure 20, including portions in which water outlets 28 and/or 28A are installed. In this embodiment, pump 50 operates in the same manner as in the embodiment shown in FIGS. 2 and 3, which is to pump treated condensate back to the drain pan 18 based on feedback from water level sensor 54 and/or programming of timer 100.

In this embodiment, the apparatus 10 may include a second water level sensor 56, which may include a float switch that automatically activates pump 52 upon the condensate level in the reservoir 42 reaching a defined set point, which may be at a higher level within the reservoir 42 than the set point for sensor 54. Pump 52 may also be operated by programming timer 100 to activate the pump 52. Thus, pump 50 may first be activated by water level sensor 54 to pump condensate back to the drain pan 18, and then pump 52 may be activated by water level sensor 56 to pump condensate to the main drain line 72. If condensate continues to accumulate in the reservoir 42 either while pump 50 is running or while pump 50 is temporarily shut off by timer 100 during periods in which the AC unit 12 is cooling, the condensate level may rise within the reservoir 42 until pump 52 is activated by water level sensor 56. A discharge outlet 78 from pump 52 may convey condensate through a condensate line (not shown) connected to fitting 82. Pump 52 may be utilized to convey treated condensate to a drain pan 18 of a secondary AC unit 12 to treat the secondary drain pan 18 and associated piping if the system includes such a secondary unit. Alternatively, pump 52 may be utilized to convey treated condensate directly to the main drain line 72 in cases in which gravity flow from the apparatus 10 to the drain line 72 is not feasible.

When using pump 52 to convey condensate to drain line 72, overflow wall 44 is not required. In this case, the controller 84 may be programmed to activate pump 52 to convey condensate to drain line 72 until float switch 56 drops below a set point, and pump 50 may be activated to pump any condensate that is below a level that sensor 56 is capable of detecting back to the drain pan 18 until float switch 54 drops below its set point. When the AC unit 12 is off for a certain amount of time, controller 84 may be programmed to activate pump 52 to pump all condensate in the reservoir 42 to the drain line 72. Alternatively, when using pump 52 to recirculate condensate to a secondary drain pan 18 of a secondary unit 12 rather than to the drain line 72, the apparatus 10 preferably includes overflow wall 44. In this embodiment, controller 84 may be programmed to activate pump 52 to convey condensate to the secondary drain pan 18 until float switch 56 drops below a set point, and pump 50 may be activated to pump any condensate that is below a level that sensor 56 is capable of detecting back to the primary drain pan 18 until float switch 54 drops below its set point. Alternatively, pump 50 and/or pump 52 may be activated by timer 100 to pump condensate to the primary and/or secondary drain pan 18 for a set period of time. Pumps 50 and 52 may also be controlled by inputs from both timer 100 and water level sensors 54 and/or 56. Alternatively, this embodiment may utilize a single water level sensor 54 that is operably connected to both pumps 50 and 52. In this case, both pumps 50 and 52 may be activated simultaneously to pump condensate to separate drain pans 18 when the condensate level reaches the set point of water level sensor 54. If too much condensate accumulates while either of pumps 50 and/or 52 are shut off, condensate may then flow over overflow wall 44 and out of water outlet 28 or 28A. Any condensate remaining in the reservoir 42 after the AC unit 12 has been turned off for a certain amount of time may drain slowly through weep hole 60 and out of water outlet 28 or 28A.

The present apparatus 10 may function as a self-contained unit that may be installed onto an AC unit 12 as a single unit 10. Installation may include connecting water inlet line 68 to water inlet 26 or 26A and connecting recirculation line 74 to fitting 80. Installation of piping may also include connecting water outlet line 70 to water outlet 28 or 28A or to fitting 82 or optionally connecting a condensate recirculation line to fitting 82. Installation may also include wiring the PCB 85 to low voltage power of the AC unit 12 to provide power to the apparatus 10 and to recharge the battery 62. Routine maintenance after installation includes periodically replacing the treatment chemical 38 and/or battery 62 as needed. All components of the apparatus 10, including trap 30, compartment 32, reservoir 42, pump 50 and/or 52, high-level sensor 58 and other optional sensors, battery 62, and PCB 85 with controller 84, may be pre-installed during manufacturing of the apparatus 10 so that these components do not need to be installed on the AC unit 12 as separate components or systems. Once the single self-contained unit is installed, the apparatus 10 provides several important functions including a trap 30 to prevent backflow of gases, condensate treatment to prevent the growth of microorganisms and potential line blockages that may be caused by such growth, and prevention of condensate overflow from the drain pan 18 through emergency shut off sensor 58.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. An apparatus comprising:

an enclosure having a wet side and a dry side, wherein the wet side has a water inlet and a water outlet;

a plumbing trap disposed within the wet side of the enclosure;

a compartment disposed within the wet side of the enclosure in a position downstream of the plumbing trap, wherein the compartment has a perforated bottom to allow water to flow out of the bottom of the compartment;

a reservoir disposed within the wet side of the enclosure in a position below the compartment, wherein the reservoir is partially defined by an overflow wall, wherein the water outlet is disposed at a lower end of the wet side of the enclosure on an opposite side of the overflow wall from the reservoir;

a pump disposed within the dry side of the enclosure, wherein the pump is configured to pump water from the reservoir to a discharge location that is external to the enclosure;

a battery disposed within the dry side of the enclosure, wherein the battery is configured to supply power to the pump;

a water level sensor configured to detect a water level within the reservoir; and a controller configured to control operation of the pump based at least in part on input from the water level sensor.

2. The apparatus of claim 1, further comprising a water treatment tablet disposed within the compartment.

3. The apparatus of claim 2, further comprising a water treatment sensor configured to detect the presence of the water treatment tablet.

4. The apparatus of claim 1, wherein the discharge location is a drain pan of an air conditioning unit.

5. The apparatus of claim 4, further comprising a high-level sensor disposed at an upstream end of the plumbing trap, wherein the high-level sensor is configured to shut down the air conditioning unit when the high-level sensor detects a high water level.

6. The apparatus of claim 1, wherein the overflow wall has a weep hole extending through the overflow wall at a position near a lower end of the overflow wall.

7. The apparatus of claim 1, wherein the compartment is partially defined by a second overflow wall, wherein the second overflow wall is disposed on an opposite side of the compartment from the plumbing trap.

8. The apparatus of claim 1, wherein the water inlet is disposed at an upper end of the wet side of the enclosure, wherein the apparatus is configured to allow water to gravity flow from the water inlet to the water outlet.

9. An apparatus comprising:

an enclosure having a water inlet and a water outlet;

a plumbing trap disposed within the enclosure;

a compartment disposed within the enclosure in a position downstream of the plumbing trap, wherein the compartment has a perforated bottom to allow water to flow out of the bottom of the compartment;

a reservoir disposed within the enclosure in a position below the compartment, wherein the reservoir is partially defined by an overflow wall, wherein the water outlet is disposed at a lower end of the enclosure on an opposite side of the overflow wall from the reservoir;

a pump configured to pump water from the reservoir to a discharge location that is external to the enclosure.

10. The apparatus of claim 9, further comprising a water treatment tablet disposed within the compartment.

11. The apparatus of claim 10, further comprising a water treatment sensor configured to detect the presence of the water treatment tablet.

12. The apparatus of claim 9, wherein the discharge location is a drain pan of an air conditioning unit.

13. The apparatus of claim 12, further comprising a high-level sensor disposed at an upstream end of the plumbing trap, wherein the high-level sensor is configured to shut down the air conditioning unit when the high-level sensor detects a high water level.

14. The apparatus of claim 9, wherein the overflow wall has a weep hole extending through the overflow wall at a position near a lower end of the overflow wall.

15. The apparatus of claim 9, wherein the compartment is partially defined by a second overflow wall, wherein the second overflow wall is disposed on an opposite side of the compartment from the plumbing trap.

16. The apparatus of claim 9, wherein the water inlet is disposed at an upper end of the wet side of the enclosure, wherein the apparatus is configured to allow water to gravity flow from the water inlet to the water outlet.

17. An apparatus comprising:

an enclosure having a water inlet and a water outlet;

a plumbing trap disposed within the enclosure;

a compartment disposed within the enclosure in a position downstream of the plumbing trap, wherein the compartment has a perforated bottom to allow water to flow out of the bottom of the compartment;

a reservoir disposed within the enclosure in a position below the compartment;

a first pump configured to pump water from the reservoir to a drain pan of an air conditioning unit;

a second pump configured to pump water from the reservoir to a drain line;

a water level sensor configured to detect a water level within the reservoir;

a controller configured to control operation of at least the second pump based at least in part on input from the level sensor.

18. The apparatus of claim 17, further comprising a water treatment tablet disposed within the compartment.

19. The apparatus of claim 17, further comprising a high-level sensor disposed at an upstream end of the plumbing trap, wherein the high-level sensor is configured to shut down the air conditioning unit when the high-level sensor detects a high water level.

20. The apparatus of claim 17, wherein the water inlet is disposed at an upper end of the wet side of the enclosure, wherein the apparatus is configured to allow water to gravity flow from the water inlet to the water outlet.

* * * * *